US008135139B2

(12) United States Patent
Neher et al.

(10) Patent No.: US 8,135,139 B2
(45) Date of Patent: Mar. 13, 2012

(54) FREQUENCY TRANSPOSITION APPLICATIONS FOR IMPROVING SPATIAL HEARING ABILITIES OF SUBJECTS WITH HIGH-FREQUENCY HEARING LOSSES

(75) Inventors: Tobias Neher, Smørum (DK); Thomas Behrens, Smørum (DK)

(73) Assignee: Oticon A/S, Smorum (DK)

( * ) Notice: Subject to any disclaimer, the term of this patent is extended or adjusted under 35 U.S.C. 154(b) by 857 days.

(21) Appl. No.: 12/222,308

(22) Filed: Aug. 6, 2008

(65) Prior Publication Data

US 2009/0074197 A1 Mar. 19, 2009

(30) Foreign Application Priority Data

Aug. 8, 2007 (EP) ..... 07114028
Nov. 2, 2007 (EP) ..... 07119852

(51) Int. Cl.
*H04R 29/00* (2006.01)

(52) U.S. Cl. ..... 381/60; 381/312

(58) Field of Classification Search ..... 381/56, 381/58–60, 98, 312, 316, 318, 320
See application file for complete search history.

(56) References Cited

U.S. PATENT DOCUMENTS

2004/0136541 A1* 7/2004 Hamacher et al. ..... 381/60
2007/0127748 A1* 6/2007 Carlile et al. ..... 381/312

FOREIGN PATENT DOCUMENTS

EP 1 414 268 A 4/2004
EP 1 742 509 A1 1/2007
WO WO-01/54453 A 7/2001
WO WO-2005/015952 A 2/2005
WO WO-2007/006658 A1 1/2007

OTHER PUBLICATIONS

Iida et al., Applied Acoustics, vol. 68, No. 8, May 5, 2007, pp. 835-850.
Zotkin D N. et al., IEEE Workshop on Applications of Signal Processing to Audio and Acoustics, Oct. 19-22, 2003, pp. 157-160.
Nishino et al., Applied Acoustics, vol. 68, May 5, 2007, pp. 897-908.
Best Virginia et al., Journal of the Acoustical Society of America, vol. 118, No. 1, Jul. 6, 2005, pp. 353-363.
Craig Jin et al., Proceedings of the 2003 International Conference on Auditory Display, Jul. 6-9, 2003, pp. 255-258.

(Continued)

*Primary Examiner* — Victor A Mandala
*Assistant Examiner* — Whitney T Moore
(74) *Attorney, Agent, or Firm* — Birch, Stewart, Kolasch & Birch, LLP

(57) ABSTRACT

A method of configuring a frequency transposition scheme for transposing a set of received frequencies of an audio signal received by a hearing aid worn by a subject to a transposed set of frequencies, wherein the method comprises determining at least one subject-dependent parameter indicative of the subject's ability to detect audio frequencies, and at least one subject-dependent parameter indicative of the location in frequency of one or more spectral cues, configuring a subject-dependent frequency transposition scheme based on the determined subject-dependent parameters, the subject-dependent frequency transposition scheme being configured so as to improve the subject's spatial hearing capabilities, and adapting the hearing aid to perform the configured subject-dependent frequency transposition scheme.

15 Claims, 2 Drawing Sheets

OTHER PUBLICATIONS

Bronkhorst, A. W. Acustica Acta Acustica, vol. 86, (2000), pp. 117-128.
Middlebrooks, J. C. et al., Ann. Rev. Psychol., vol. 42, (1991), pp. 135-159.
Wightman, F. L et al., "Factors Affecting the Relative Salience of Sound Localization Cues" 1997, pp. 1-23.
Wightman, F. et al., Acta Acustica United With Acustica, vol. 91, (2005), pp. 429-439.
Shaw, E, A. G., Acoustical Features of the Human External Ear, (1997), pp. 25-47.
Durrant, J. D. et al., :Bases of Hearing Science, Baltimore Maryland: Williams & Wilkins, (1995), pp. 175-176.
Bronkhorst, A. W. et al., Acta Acust. Acust. vol. 91, (2005), pp. V-XII.
Mehrgardt, S. et al., J. Acoust. Soc. Am., vol. 61, (1977), pp. 1567-1576.
Moore, B. C. J. Cochlear Hearing Loss, London: Whurr Publishers Ltd., (1198), pp. 150-167.
Weinrich, S., Scand. Audiol. Suppl., vol. 15, (1982), pp. 135-145.
Carlile, S. et al., Int. Rev. Neurobiol., vol. 70, (2005), pp. 399-434.
Lopez-Poveda, E. A. The Physical Origin and Physiological Coding of Pinna-Based Spectral Cues, PhD Thesis, Dept. of Human Science, (1996), pp. 109-133.
Lopez-Poveda, E. A. et al., J. Acoust. Soc. Am., vol. 100, (1996), pp. 3248-3259.
DiGiovanni, J.J. et al., J. Acoust. Soc. Am., vol. 120, (2006), pp. 1529-1538.
Musa-Shufani, S. et al., Ear Hear., vol. 27, (2006), pp. 279-285.
Agnew, J. Hear. Instr. vol. 45, (1994), pp. 22-25.
Arlinger, S., Manual of Practical Audiometry, vol. 2, (1991), pp. 40-53.
Shaw, E. A. G. et al., J. Acoust. Soc. Am., vol. 44, (1968), pp. 240-249.
Dillon, H. Hearing Aids, Sydney: Boomerang Press, (2001), p. 248.
Middlebrooks, J. C., J. Acoust. Soc. Am., vol. 106, (1999), pp. 1480-1492.
Berland, O. et al., Oticon Laboratories, Copenhagen, Denmark, (1968).
ANSI S3.5-1997, American National Standards Institute, New York.

* cited by examiner

FREQUENCY TRANSPOSITION APPLICATIONS FOR IMPROVING SPATIAL HEARING ABILITIES OF SUBJECTS WITH HIGH-FREQUENCY HEARING LOSSES

FIELD OF THE INVENTION

This invention generally relates to a method of configuring a frequency transposition scheme for transposing frequencies received by a hearing aid worn by a subject as well as an apparatus adapted to perform the transposition. The invention further relates to a hearing aid adapted to perform frequency transposition of incoming sounds. More particularly, the invention relates to transposing frequencies for improving spatial hearing abilities of subjects with high-frequency hearing losses.

BACKGROUND OF THE INVENTION

People who suffer from a hearing loss most often have problems detecting high frequencies in sound signals. This is a major problem since high frequencies in sound signals are known to offer advantages with respect to spatial hearing such as the ability to identify the location or origin of a detected sound ("sound localisation"). Consequently, spatial hearing is very important for people's ability to perceive sound and to interact with and navigate in their surroundings. This is especially true for more complex listening situations such as cocktail parties, in which spatial hearing can allow people to perceptually separate different sound sources from each other, thereby leading to better speech intelligibility [e.g. Bronkhorst, A. W. (2000), "The cocktail party phenomenon: A review of research on speech intelligibility in multiple-talker conditions," *Acta Acust. Acust.,* 86, 117-128].

From the psychoacoustic literature it is apparent that, apart from interaural temporal and level differences, sound localisation is mediated by monaural spectral cues, i.e. peaks and notches that usually occur at frequencies above 3 kHz [e.g. Middlebrooks, J. C., and Green, D. M. (1991), "Sound localization by human listeners," *Ann. Rev. Psychol.,* 42, 135-159; Wightman, F. L., and Kistler, D. J. (1997), "Factors affecting the relative salience of sound localization cues," In: R. H. Gilkey and T. A. Anderson (eds.), *Binaural and Spatial Hearing in Real and Virtual Environments*, Mahwah, N.J.: Lawrence Erlbaum Associates, 1-23]. Since hearing-impaired subjects are usually compromised in their ability to detect frequencies higher than 3 kHz, they suffer from reduced spatial hearing abilities.

In principle, the term "frequency transposition" can imply a number of different approaches to altering the spectrum of a signal. For instance, "frequency compression" refers to compressing a (wider) source frequency region into a narrower target frequency region, e.g. by discarding every n-th frequency analysis band and "pushing" the remaining bands together in the frequency domain. In the context of this invention, this will be termed the frequency-compression approach. "Frequency lowering" refers to shifting a high-frequency source region into a lower-frequency target region without discarding any spectral information contained in the shifted high-frequency band. Rather, the higher frequencies that are transposed either replace the lower frequencies completely or they are mixed with them. In the context of this invention, this will be termed the frequency-lowering approach. In principle, both types of approaches can be performed on all or only some frequencies of a given input spectrum. In the context of this invention, both approaches are intended to transpose higher frequencies downwards, either by compression or lowering. Generally speaking, however, there may be one or more high-frequency source bands that are transposed downwards into one or more low-frequency target bands, and there may also be another, even lower frequency band (the "baseband") remaining unaffected by the transposition.

Frequency transposition of particular frequency regions in hearings aids is a known technique for improving the benefits of hearing-aid users. For example, patent application WO 2005/015952 describes a system that aims at improving the spatial hearing abilities of hearing-impaired subjects. The proposed system discards every n-th frequency analysis band and pushes the remaining ones together, thus applying frequency compression. As a result, spatially salient high-frequency cues are assumed to be reproduced at lower frequencies.

In general, hearing aids may be of the behind-the-ear (BTE), mostly-in-the-ear (MIC), in-the-ear (ITE), completely-in-the-canal (CIC), or receiver-in-the-ear (RITE) type.

Patent application EP 1,742,509 relates to eliminating acoustical feedback and noise by synthesizing an audio input signal of a hearing device. Even though this method utilises frequency transposition, the purpose of frequency transposition in this prior art method is to eliminate acoustical feedback and noise in hearing aids and not to improve spatial hearing abilities.

Even though the above mentioned prior art methods provide improved hearing abilities for many subjects, even more hearing-impaired subjects could be helped, and it therefore remains a problem to obtain a further improvement of the effect of frequency transposition in a hearing aid and thus improved spatial hearing of hearing-impaired subjects.

SUMMARY

Disclosed is a method of configuring a frequency transposition scheme for transposing a set of received frequencies of an audio signal received by a hearing aid worn by a subject to a transposed set of frequencies, wherein the method comprises:

- determining at least one subject-dependent parameter indicative of the subject's ability to detect audio frequencies and at least one subject-dependent parameter indicative of the location in frequency of one or more spectral cues,
- configuring a subject-dependent frequency transposition process based on the determined subject-dependent parameters, the subject-dependent frequency transposition being configured so as to improve the subject's spatial hearing capabilities, and
- adapting the hearing aid to perform the configured subject-dependent frequency transposition.

It is an advantage of the present invention that audio frequencies, which a subject has limited access to due to a hearing impairment, are transposed to frequencies which the subject can detect by means of a hearing aid. The configuration of the transposition process is based on at least one subject-dependent parameter indicative of that specific subject's ability to detect audio frequencies (e.g. the audiogram) and at least one subject-dependent parameter indicative of the location in frequency of one or more spectral cues, in particular spatially-salient spectral cues. In particular, it is expected that by performing subject-dependent frequency transposition based on at least one of the parameters determined for each individual subject, the subject's spatial hearing capabilities can be significantly improved.

Embodiments of the method described herein utilise a number of audiologically-motivated approaches, so as to improve the spatial hearing abilities of subjects with high-frequency hearing impairments.

Furthermore, since the subject-dependent frequency transposition is based on predetermined, objectively measured parameters, the configuration of the frequency transposition may be performed in a reproducible manner and with controllable quality. For example, the configuration is less dependent or even completely independent of the person performing the configuration.

In conclusion, the precise details of the transposition are determined based on information about the subject's hearing loss and location in frequency of spatially-salient spectral cues.

As previously mentioned, since hearing-impaired subjects are usually compromised in their ability to detect frequencies higher than 3 kHz, they suffer from reduced spatial hearing abilities. Hence, it is an advantage of the present invention that in one embodiment the frequency transposition is configured to downward-transpose at least one high-frequency source region.

The term 'spectral cues' is used herein to refer to properties of the received frequency spectrum (such as peaks and notches), i.e. in particular the high-frequency spectral information to be transposed downwards so as to improve the subject's spatial hearing abilities. Accordingly, spatially-salient spectral cues are cues that carry information which the subject can utilise for sound localisation or, more generally, spatial hearing purposes.

The spectral cues salient with respect to spatial hearing mentioned above arise due to the physical structure of the human outer ear and are commonly measured in terms of so-called head-related transfer functions (HRTFs) [e.g. Wightman, F., and Kistler, D. (2005), "Measurement and validation of human HRTFs for use in hearing research," *Acta Acust. Acust.,* 91, 429-439].

Accordingly, in one embodiment determining the subject-dependent parameters includes a geometric measurement of the physical dimensions of one or more anatomical features of at least one outer ear of the subject. In another embodiment determining the at least one subject-dependent parameter includes a geometric measurement of the physical dimensions of the subject's head, thus providing a particularly simple geometric measurement. Such geometric measurements of a subject's outer ear(s) or head may determine which frequency transposition configuration is suitable for that subject. A further advantage of this embodiment is that a geometric measurement is an objective and reproducible measurement.

Since a subject's ability to detect high-frequency spectral cues depends on both the subject's hearing loss profile and the frequency location of these cues, performing the same frequency transposition for every subject will not be optimal, and hence it is an advantage of embodiments of the method described herein that the frequency transposition is subject-dependent.

In one embodiment the method comprises comparing the geometric measurement with predetermined physical models of the outer ear [e.g. Shaw, E. A. G. (1997), "Acoustical features of the human external ear," In: R. H. Gilkey and T. A. Anderson (eds.), *Binaural and Spatial Hearing in Real and Virtual Environments*, Mahwah, N.J.: Lawrence Erlbaum Associates, 25-47] so as to determine at least one source frequency region containing spectral cues, in particular spatially-salient spectral cues. This enables an assessment of which of these cues are accessible for a given person with a given hearing loss and which are not accessible. Based on this assessment, a transposition scheme can be derived, which optimises accessibility of the transposed cues for the given person. Comparison of the geometric measurement of the subject's ear with a predetermined physical model of the ear has the advantage of improving the configuration of the frequency transposition, since information about the location in frequency of spatially-salient spectral cues can be combined with information about the same subject's hearing impairment.

In one embodiment the geometric measurement is a measurement of at least one physical dimension, i.e. the width, depth or height, of the outer ear itself, the concha cavity, the ear canal or any other anatomical feature of the outer ear. Salient anatomical features of the outer ear determine the magnitude as well as the location in frequency of the spatially-salient cues, which is why it is an advantage to perform a geometric measurement of these anatomical parts of the ear or head of the hearing-impaired subject.

In one embodiment the at least one subject-dependent physical parameter related to the head and outer ears is indicative of one or more of the following: the location in frequency of one or more predetermined spectral cues, e.g. spectral peaks and notches, the subject's head-related transfer function, the subject's open-ear or ear-canal resonance, or a combination thereof.

In one embodiment the at least one subject-dependent physical parameter may simply be derived from demographic information about the subject. For instance, a subject's age, gender and body height are known to have an influence on the physical dimensions of a subject's outer ears. Therefore, this type of information can also provide an indication of the location in frequency of spatially-salient spectral cues.

All of the above factors are, as mentioned, subject-dependent and influence where in frequency the high-frequency spectral cues are located. It is an advantage of embodiments of the method described herein that by considering one, some, or all of these factors and by combining them with information from an audiogram, a subject's spatial hearing abilities are improved or even optimised. A specific frequency transposition scheme can thus be determined for the hearing-impaired subject, so that this subject's capabilities of detecting spatial hearing cues are improved.

Apart from the distinction between frequency compression and frequency lowering, the frequency transposition method described in this document can be subdivided into a number of different, audiologically-motivated approaches for selecting and transposing high-frequency spectral cues. The most significant difference between these approaches is whether the spectral cues that are transposed downwards are broadband or narrowband cues. Directly related to this is the level of detail required in the geometric model that is used to predict the location in frequency of the spatially-salient spectral cues. The different approaches are explained below.

Generally speaking, if the size of a given physical object is comparable to the wavelength of an impinging sound, the object will constitute an obstacle for that sound and hence will affect it. Acoustical measurements show that the human head starts having an effect on frequencies above ~1 kHz [Durrant, J. D., and Lovrinic, J. H. (1995), *Bases of Hearing Science*, Baltimore, Md.: Williams & Wilkins]. This means that, if a broadband sound source is located on one side of a listener, then as a result of acoustical interactions there will be a build-up of sound pressure at the ear nearer to the source and a decrease of sound pressure at the ear farther away from the source. This boosting and attenuating of the sound signal occurs over a comparatively large frequency range and can therefore be considered a broadband effect. In the literature, this is typically referred to as the "head-shadow effect" [e.g. Shaw, E. A. G. (1997), "Acoustical features of the human external ear," In: R. H. Gilkey and T. A. Anderson (eds.), *Binaural and Spatial Hearing in Real and Virtual Environments*, Mahwah, N.J.: Lawrence Erlbaum Associates, 25-47].

The first audiologically-motivated approach to configuring the frequency transposition algorithm involves restoring, for a given frequency bandwidth that is determined by a subject's hearing loss, as much of the head-shadow effect as possible. In essence, a frequency region is chosen such that, on average, it provides the largest boost and attenuation of a sound signal across a listener's two ears for the given frequency bandwidth. Such transposition is advantageous because normal-hearing listeners are known to benefit from high-frequency head-shadow effects under complex listening conditions such as cocktail parties where there are multiple sound sources that overlap in time and frequency. To illustrate, if there is a target source on one side and an interfering source on the other side of a listener's head, then due to the head-shadow effect there will be a larger signal-to-noise ratio (SNR) at the ear that is on the same side of the head as the target source. Similarly, there will be a lower SNR at the ear on the side of the interfering source. Such head-shadowing can lead to a 7-8 dB SNR improvement at the target ear, and normal-hearing subjects are known to achieve better speech intelligibility in such situations by attending to this "better" ear [Bronkhorst, A. W., and Brungart, D. S. (2005), "Advances in research on spatial and binaural hearing," *Acta Acust. Acust.,* 91, V-XII].

In one embodiment of the frequency transposition scheme, the frequency region with the overall largest head-shadow effect is therefore determined and transposed. Whilst the frequency-lowering approach seems to be most suitable for this implementation, frequency compression should in principle also be usable. Assuming that a 2 kHz bandwidth is available for transposition, the 6-8 kHz frequency region would be a good initial choice that should work reasonably well for a large number of subjects. This is because measurements averaged over 20 human subjects show that the magnitude of the head-shadow effect is largest in that frequency band [Mehrgardt, S., and Mellert, V. (1977), "Transformation characteristics of the external human ear," *J. Acoust. Soc. Am.,* 61, 1567-1576]. Nevertheless, there may be subjects for which, due to their hearing loss configuration, a smaller or wider frequency bandwidth needs to be transposed. Furthermore, the 6-8 kHz frequency band may not be the optimal choice for each subject, since the head size influences where in frequency the head-shadow effect is most pronounced. Consequently, in some embodiments of the transposition scheme, both of these factors are taken into consideration. Implementations that are meant to restore head-shadowing effects are intended primarily for subjects that have a more severe hearing loss. These subjects have reduced frequency selectivity and thus less chance of detecting or resolving finer spectral peaks and notches [e.g. Moore, B. C. J. (1998), *Cochlear Hearing Loss*, London: Whurr Publishers Ltd.].

Since the human outer ear is much smaller than the human head, it affects impinging sound waves at higher frequencies, i.e. above approximately 3 kHz [e.g. Weinrich, S. (1982), "The problem of front-back localization in binaural hearing," *Scand. Audiol. Suppl.,* 15, 135-145; Wightman, F. L., and Kistler, D. J. (1997), "Factors affecting the relative salience of sound localization cues," In: R. H. Gilkey and T. A. Anderson (eds.), *Binaural and Spatial Hearing in Real and Virtual Environments*, Mahwah, N.J.: Lawrence Erlbaum Associates, 1-23]. Due to the fact that the pinna has a very complicated structure, it alters high-frequency sound in a complicated manner. More specifically, the pinna can be considered a direction-dependent filter that introduces spectral peaks and notches into the ear signals, which vary as a function of source position [e.g. Carlile, S., Martin, R., and McAnally, K. (2005), "Spectral information in sound localization," *Int. Rev. Neurobiol.,* 70, 399-434]. These features are widely considered to be responsible for improved localisation performance in normal-hearing listeners, especially in the vertical plane and with respect to discriminating between frontal and rearward sources [e.g. Middlebrooks, J. C., and Green, D. M. (1991), "Sound localization by human listeners," *Ann. Rev. Psychol.,* 42, 135-159]. Compared to the head-shadow effect, these spectral cues are much more narrowband. Moreover, they are correlated with the dimensions of smaller anatomical features such as the width, depth and height of the concha cavity, the tragus, or the pinna flange [Lopez-Poveda, E. A. (1996), "The physical origin and physiological coding of pinna-based spectral cues," *PhD Thesis*, Dept. of Human Sciences, Loughborough University, UK]. Thus, to predict the location in frequency of these cues, much more elaborate geometric measurements and models of the human outer ear are required.

In some embodiments of the frequency transposition scheme, the frequency region over which one or more individual spectral peaks and notches vary maximally is therefore determined based on comparisons of measurements of the physical dimensions of some or all relevant anatomical features with existing models [e.g. Shaw, E. A. G. (1997), "Acoustical features of the human external ear," In: R. H. Gilkey and T. A. Anderson (eds.), *Binaural and Spatial Hearing in Real and Virtual Environments*, Mahwah, N.J.: Lawrence Erlbaum Associates, 25-47; Lopez-Poveda, E. A., and Meddis, R. (1996), "A physical model of sound diffraction and reflection in the human concha," *J. Acoust. Soc. Am.,* 100, 3248-3259]. These source frequency regions are then transposed downwards, either by means of frequency lowering or frequency compression techniques, into target frequency bands having certain bandwidths that were previously determined based on the subject's audiogram. This implementation is intended primarily for subjects that have a milder hearing loss and hence sufficient remaining frequency selectivity, as such subjects have a much higher chance of detecting or resolving finer spectral peaks and notches.

In addition to the embodiments outlined above, there can be other implementations. For example, the frequency region over which a given spectral cue varies maximally may also be predictable from the physical dimensions of the pinna as a whole and not just from those of smaller anatomical components. Hence, a less elaborate geometric model may be sufficient for selecting the appropriate frequency region that is to be transposed downwards. A model that is even less elaborate could be based on demographic information about a subject such as age, gender and body height to predict the frequency location of spatially-salient spectral cues.

In one embodiment the method further comprises enhancing individual spectral cues of the subject's head-related transfer function. As an example the method may comprise enhancing spectral peaks or notches, the centre frequencies of which are correlated with certain physical dimensions of certain anatomical features of the outer ear and thus can be predicted with the help of an ear-geometry model, by boosting a peak and/or attenuating the energy adjacent to the peak, or by attenuating a notch and/or boosting the energy adjacent to the notch. An advantage of this embodiment is that both normal-hearing and impaired-hearing subjects are better able to detect these spectral features when they are enhanced [e.g.

DiGiovanni, J. J., and Nair, P. (2006), "Auditory filters and the benefit measured from spectral enhancement," *J. Acoust. Soc. Am.,* 120, 1529-1538].

In one embodiment configuring a subject-dependent frequency transposition comprises determining a subject-dependent bandwidth of a transposed frequency region and a transition frequency between an unmodified baseband and a replaced frequency region. It is an advantage of this embodiment that the bandwidth of the transposed frequency region and the transition frequency is subject-dependent, since this provides optimal frequency transposition for a subject.

In one embodiment the method further comprises synchronizing the frequency transposition across the two ears of a subject when this subject is wearing a hearing aid in both ears. Consequently, any interaural level or time difference cues contained within the transposed frequency band are preserved.

In addition to such frequency transposition synchronization, the method may comprise synchronizing dynamic range compression across the two hearing aids of the subject. Dynamic range compression is typically applied to "squeeze" the (physical) level range of an input signal into the (perceptual) level range of hearing-impaired subjects. Non-synchronised dynamic range compression has recently been shown to result in poorer directional hearing performance of bilaterally fitted normal-hearing and impaired-hearing subjects, because such compression can reduce high-frequency interaural level differences [Musa-Shufani, S., Walger, M., von Wedel, H., and Meister, H. (2006), "Influence of dynamic compression on directional hearing in the horizontal plane," *Ear Hear.,* 27, 279-285]. Thus, by synchronising dynamic range compression across the two aids of the subject, interaural cues contained in both transposed and non-transposed frequency bands can be preserved, thereby maintaining optimal contribution to spatial hearing performance. An advantage of this embodiment is therefore that when a hearing-impaired subject is wearing two hearing aids, one on each ear, the acoustical effects of the two hearing aids on the ear signals are taken into account.

In one embodiment the method further comprises adjusting the frequency transposition according to the position of one or more microphones of the hearing aid. This is advantageous because the acoustical effects occurring in the concha cavity are different from those occurring above or behind the outer ear, for example [Agnew, J. (1994), "Acoustic advantages of deep canal hearing aid fittings," *Hear. Instr.,* 45, 22-25]. That is why the high-frequency spectral cues are also position-dependent. An advantage of this embodiment is that the effect of the position of the hearing aid microphone(s) is taken into account when configuring the transposition.

In one embodiment a suitable frequency-dependent gain for audio signals processed through the hearing aid is determined based on an open-ear resonance. As is the case for the spectral peaks and notches used in sound localisation, the open-ear resonance can vary from subject to subject, and it is an advantage that the open-ear resonance is predicted for each subject with the help of an ear-geometry model. If there is a mismatch between predicted and actual open-ear response, poorly prescribed gain will be the result. Consequently, the gain of the audio signals processed by a hearing aid is determined on the basis of the subject-dependent open-ear resonance, which has the effect that the audiological amplification typically prescribed in hearing aids is more suitable for the specific subject.

In one embodiment performing the frequency transposition includes performing a Fast Fourier Transform (FFT). In another embodiment performing the frequency transposition includes performing the frequency transposition by means of a filterbank. Consequently, the frequency transposition may be performed in several ways so as to lead to the most efficient and effective implementation.

The present invention relates to different aspects including the method of configuring frequency transposition described above and in the following, and corresponding methods, devices, and/or product means, each yielding one or more of the benefits and advantages described in connection with the first mentioned aspect, and each having one or more embodiments corresponding to the embodiments described in connection with the first mentioned aspect and/or disclosed in the appended claims.

Disclosed is a hearing aid adapted to perform a frequency transposition of a set of received frequencies of an audio signal to a transposed set of frequencies, wherein the hearing aid comprises storage means having stored therein at least one subject-dependent configuration parameter configured based on the subject's ability to detect audio frequencies (e.g. the subject's audiogram) and the location in frequency of the subject's spectral cues, in particular spatially-salient spectral cues, and processing means for processing a subject-dependent frequency transposition configured from the at least one subject-dependent configuration parameter, the subject-dependent frequency transposition being configured to facilitate the subject's spatial hearing capabilities.

It is an advantage of this embodiment that the hearing aid is configured to take into account which frequencies the subject has no or only limited access to, and hence the subject experiences optimal hearing capability when wearing the hearing aid due to the specific transposition of frequencies in the hearing aid.

Here and in the following, the term 'processing means' comprises any circuit and/or device suitably adapted to perform the above functions. In particular, the term 'processing means' comprises general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

The term 'storage means' comprises any suitable circuitry or device for storing the determined configuration parameters, e.g. a non-volatile memory, such as a ROM, an EPROM, and EEPROM, a flash memory, and/or the like. Alternatively or additionally, the determined parameter(s) may be stored as part of a program for controlling the processing means.

Consequently, when the frequency transposition is carried out in a subject-dependent manner by measuring the dimensions of predetermined salient anatomical features of the head and/or outer ear(s), the frequency locations of the spectral cues can be predicted and the cues themselves be transposed. In some embodiments, a combination with information about hearing loss configuration determined by means of standardised audiometric procedures is performed, and the transposition scheme can then be configured in such a way that, for each subject, best possible access to the spectral cues is ensured.

Consequently, it is an advantage that the frequency transposition is configured for each individual subject based on geometric measurements of salient anatomical features of the subject, since this is expected to result in optimal spatial hearing abilities and therefore improved speech intelligibility for each subject.

BRIEF DESCRIPTION OF THE DRAWINGS

The above and/or additional objects, features and advantages of the present invention, will be further elucidated by the following illustrative and non-limiting detailed description of embodiments of the present invention, with reference to the appended drawings, wherein.

DETAILED DESCRIPTION

In the following description, reference is made to the accompanying figures, which show by way of illustration how the invention may be put into practice.

Figure 1:
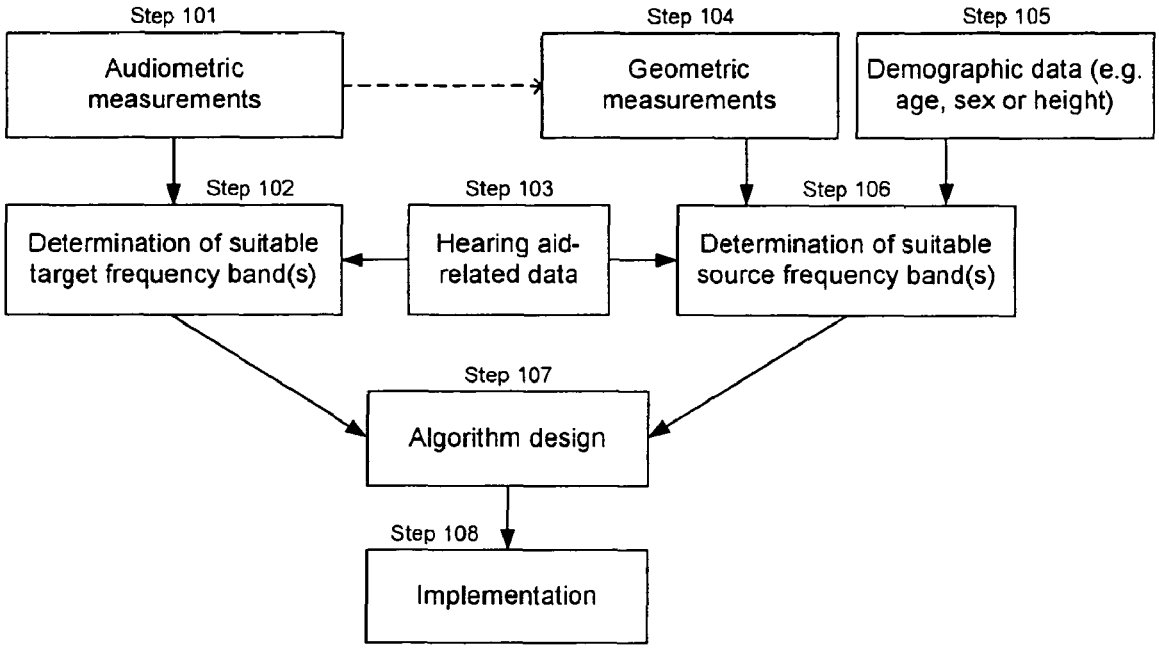
FIG. 1 shows a flow diagram displaying a general procedure of configuring and implementing a subject-dependent frequency transposition scheme.

In FIG. 1 the overall process of configuring and implementing a subject-dependent frequency transposition scheme is displayed. In initial step 101, the subject's residual hearing sensitivity is determined by means of standard audiometric measurement procedures [e.g. Arlinger, S. (1991), *Manual of Practical Audiometry—Volume* 2, London: Whurr Publishers Ltd.]. Estimates of hearing thresholds are thereby obtained that reveal the subject's configuration and degree of hearing loss. If a relatively mild hearing loss is diagnosed, the subject should have sufficient residual frequency resolution to resolve finer spectral cues [e.g. Moore, B. C. J. (1998), *Cochlear Hearing Loss*, London: Whurr Publishers Ltd.]. By contrast, if a more pronounced hearing loss is diagnosed, the subject's frequency resolution is likely to be severely compromised. Consequently, the results from the audiometric evaluation can have a bearing on the type of spatially-salient spectral cues most suitable for that subject and therefore on the measurements that are made to determine these (step 104).

In subsequent step 102, the audiometric measurements are used to determine at least one target frequency band suitable for the subject under consideration, e.g. at least one frequency band where the subject has sufficient residual hearing sensitivity to distinguish spectral cues. As an illustrative and non-limiting example, for a subject with adequate residual hearing sensitivity up to 6 kHz but little residual sensitivity at higher frequencies, the 4-6 kHz region could be chosen as the target frequency band. Any spatially-salient spectral cues occurring at higher frequencies could then be transposed into that target frequency band, where, given the subject's better residual hearing sensitivity, they should be of much greater benefit to that subject. Such an approach would result in a transition frequency of 4 kHz between an unmodified baseband (0-4 kHz) and the target frequency band (4-6 kHz). To give another illustrative and non-limiting example, if the subject had a milder, more gradually sloping hearing loss with adequate residual hearing sensitivity up to 8 kHz, the 4-8 kHz region could be chosen as the target frequency band for that subject. Hence, this subject would have a target frequency band that was twice as wide as the one in the previous example, so that for this subject transposition could be based on high-frequency spatial information occurring over a wider frequency range. These two examples illustrate that the target frequency bands are chosen according to the degree and configuration of the hearing loss to be treated, so that a given subject can be served in the most suitable fashion.

In step 104, one or more geometric measurements of anatomical features of a hearing-impaired subject's outer ear(s) and/or head are performed. In some embodiments it is sufficient to measure dimensions of the subject's head, while other embodiments require measurements of the outer ear(s) or even of individual anatomical components of the outer ear(s). The actual measurements being made are related to the subject's hearing loss profile. For highly hearing-impaired subjects with limited frequency selectivity, it may be advantageous to try to restore access to broadband head-shadowing effects, and so measurements of the head dimensions may suffice. Such simple geometric measurements can be performed with the help of a tape measure or any other suitable measuring device that can be used to determine the depth, width and height of the head, for example. For less hearing-impaired subjects with adequate residual frequency selectivity, it may be advantageous to try to restore access to narrow-band spectral peaks and notches, and so individual anatomical parts of the pinna may be measured. Such geometric measurements can be performed by means of an ear scanner or any other suitable measuring device, which can measure the depth, width and height of the pinna as a whole or those of the concha cavity and the ear canal, for example.

Research has shown that resonances in the concha cavity give rise to spectral peaks in head-related transfer functions [Shaw, E. A. G., and Teranishi, R. (1968), "Sound pressure generated in an external-ear replica and real human ears by a nearby point source," *J. Acoust Soc. Am.,* 44, 240-249]. Moreover, there are indications that spectral notches are also produced in the concha cavity, although other anatomical features of the outer ear such as the pinna flange may have an influence on their occurrence, too [Lopez-Poveda, E. A. (1996), "The physical origin and physiological coding of pinna-based spectral cues," *PhD Thesis*, Dept. of Human Sciences, Loughborough University, UK]. Another prominent feature of the human outer ear is the open-ear resonance. For a typical adult, this dominating characteristic of the natural amplification applied by the outer ear to sounds propagating from the free field to the eardrum has a centre frequency of approximately 2.7 kHz. In extreme cases, however, it can vary between 1-6 kHz [Dillon, H. (2001), *Hearing Aids*, Sydney: Boomerang Press]. Thus, by measuring the dimensions of the anatomical features that give rise to these acoustical characteristics, subject-dependent information about them can be obtained that can subsequently be used when configuring the frequency transposition scheme and when prescribing the gain applied in the hearing aid.

In step 105, demographic factors such as the subject's age, gender or body height may be registered, since these are known to have an impact on the overall size of the subject's head and pinnae, too. Hence, this type of information can be used in order to obtain additional, basic information about the location in frequency of the subject's spatial cues.

In step 106, the geometric measurements and/or demographic data are used to determine at least one source frequency band suitable for the subject under consideration, e.g. the frequency region over which a given spectral cue varies maximally or is most pronounced. As pointed out above, there is a direct relationship between the size of the head as well as the human outer ear and its individual anatomical components (e.g. the concha cavity) and the location in frequency of the spatially-salient spectral cues that these body components give rise to [e.g. Middlebrooks, J. C. (1999), "Individual differences in external-ear transfer functions reduced by scaling in frequency," *J. Acoust. Soc. Am.,* 106, 1480-1492]. A tall person with comparatively large outer ears can be expected to exhibit spatially-salient spectral cues that occur lower in frequency compared to those of a smaller person with comparatively small outer ears. Determination of the precise location in frequency of these cues can, for example, be performed by comparing the geometric measurements with predetermined physical models of the head and/or outer ears [e.g. Shaw, E. A. G. (1997), "Acoustical features of the human external ear," In:

R. H. Gilkey and T. A. Anderson (eds.), *Binaural and Spatial Hearing in Real and Virtual Environments*, Mahwah, N.J.: Lawrence Erlbaum Associates, 25-47; Lopez-Poveda, E. A., and Meddis, R. (1996), "A physical model of sound diffraction and reflection in the human concha," *J. Acoust. Soc. Am.,* 100, 3248-3259]. Determining precisely where in frequency the cues occur is advantageous, as this enables selection of one or more source frequency bands most suitable for a given subject, i.e. the frequency region containing maximal information with respect to a given spatially-salient spectral cue.

Furthermore, when determining the location in frequency of spatially-salient spectral cues, it may also be useful to consider the influence of hearing aid-related factors (step 103). An example would be the location of the input transducer(s), e.g. microphone(s), of the hearing aid, in which the frequency transposition scheme is to be implemented. For example, for hearing aids of the CIC type, the microphones are located at the ear-canal entrance, and so they can capture all the spatially-salient spectral cues originating in the pinnae. However, for hearing aids of the BTE type, the microphones are located above or behind the pinnae where the acoustical effects of the human head and outer ears on impinging sound waves are known to be different [Berland, O., and Nielsen, T. E. (1968), "Sound pressure generated in the human external ear by a free sound field," *Oticon Laboratories*, Copenhagen, Denmark]. Consequently, with BTE devices the available spatially-salient spectral cues have different acoustical properties, which have to be taken into account in the selection of suitable source frequency bands, so that the spectral cues of interest can be optimally restored for a given microphone location.

Another example of a hearing aid-related factor that could have an influence on the determination of suitable source frequency bands would be the input bandwidth of the hearing aid. This is because the highest frequency the hearing-aid microphone(s) could faithfully transmit would set the limit in terms of how high in frequency the source frequency bands could be located.

Furthermore, when determining suitable target frequency bands, it may also be necessary to consider the influence of hearing aid-related data or factors. An example of a hearing aid-related factor that could have a bearing on the determination of suitable target frequency bands would be the output bandwidth of the hearing aid. This is because the highest frequency a hearing-aid output transducer, e.g. a receiver or loudspeaker, could faithfully transmit would set the limit in terms of how high in frequency the target frequency bands could be located.

Similar to the prediction of the acoustical properties of spectral peaks and notches with the help of ear-geometry models, the open-ear resonance may be predicted based on measurements of the dimensions of the ear canal. Such knowledge may then be used to ensure correct gain for sounds processed through a hearing aid in the frequency region surrounding the open-ear resonance. This is useful because proper amplification in the frequency region from 1-3 kHz significantly contributes to obtaining good speech intelligibility [ANSI S3.5-1997 (1997), "Methods for the calculation of the intelligibility index," *American National Standards Institute*, New York]. If, on the other hand, an average estimate of the open-ear resonance was used and a hearing-aid user's own resonance differed notably from that average, a less suitable prescription of amplification in that particular frequency region would be the result.

Based on the information available from steps 101 to 106, a frequency transposition algorithm is then designed for the specific subject in step 107. In particular, the source frequency band containing spatially-salient spectral cues which the subject is unable to detect due to its high-frequency hearing loss is transposed into the target frequency region where the subject has sufficient remaining hearing sensitivity. In this case, the target frequency band determines the maximum available bandwidth for the frequency transposition. Consequently, if the source frequency band occupies a frequency range that exceeds one of the target frequency band, it will have to be compressed into the available bandwidth by means of frequency compression. To give an illustrative and non-limiting example, if the 4-8 kHz region was determined as the target frequency band suitable for a given subject, then a 4-12 kHz source frequency band could be compressed into that target frequency band using a compression ratio of 2:1. This would then imply that half of the information contained in the source frequency band would be discarded.

To give another illustrative and non-limiting example, if the 4-6 kHz region was determined as the target frequency band suitable for a subject, then a 6-8 kHz source frequency band could be transposed into that target frequency band by means of frequency lowering. In principle, it would also be possible to transpose multiple (narrower) source frequency bands (e.g. 6-8 kHz and 9-11 kHz) into a single (wider) target frequency band (e.g. 3-7 kHz) or a single source frequency band (e.g. 7-9 kHz) into multiple target frequency bands (e.g. 3-5 kHz and 5-7 kHz).

Apart from the issues outlined above, other issues may be taken into account when designing the transposition algorithm.

As a result of their hearing loss, hearing-impaired subjects are less able to detect spectral peaks and notches than normal-hearing ones [e.g. Moore, B. C. J. (1998), *Cochlear Hearing Loss*, London: Whurr Publishers Ltd.]. Recent research has shown, however, that both normal-hearing and hearing-impaired subjects become better at detecting spectral peaks when they are enhanced by either boosting the spectral peaks or by attenuating the energy adjacent to them [DiGiovanni, J. J., and Nair, P. (2006), "Auditory filters and the benefit measured from spectral enhancement," *J. Acoust. Soc. Am.,* 120, 1529-1538]. Thus, the frequency transposition algorithm may be implemented in such a manner that it can accommodate manipulation of the spectral shape of the source frequency band, so that the spatial cues of interest can be made more pronounced.

In bilateral fittings, the frequency transposition algorithm described herein may be further extended by synchronizing the transposition applied in the two hearing aids of a subject. This means that the same transposition parameters could be used in both hearing aids. Additionally and/or alternatively, through the use of wireless "ear-to-ear" communication, dynamic range compression could be synchronized across the two hearing aids. Both types of synchronization may be advantageous in that they would help preserve interaural spatial cues contained in both transposed and non-transposed frequency bands. This, in turn, would mean that optimal contribution of these cues to spatial hearing performance would be maintained.

In step 108, the configured frequency transposition algorithm is implemented in a hearing aid which is adapted to be worn by the hearing-impaired subject in order to improve the spatial hearing abilities of that subject. The technical realisation of the frequency transposition may be based on any suitable technique, e.g. an FFT-based or a filterbank-based realisation may be chosen. Examples of such implementational realisations in hearing aids are disclosed in EP 1742509 and WO 2005/015952.

Figure 2:
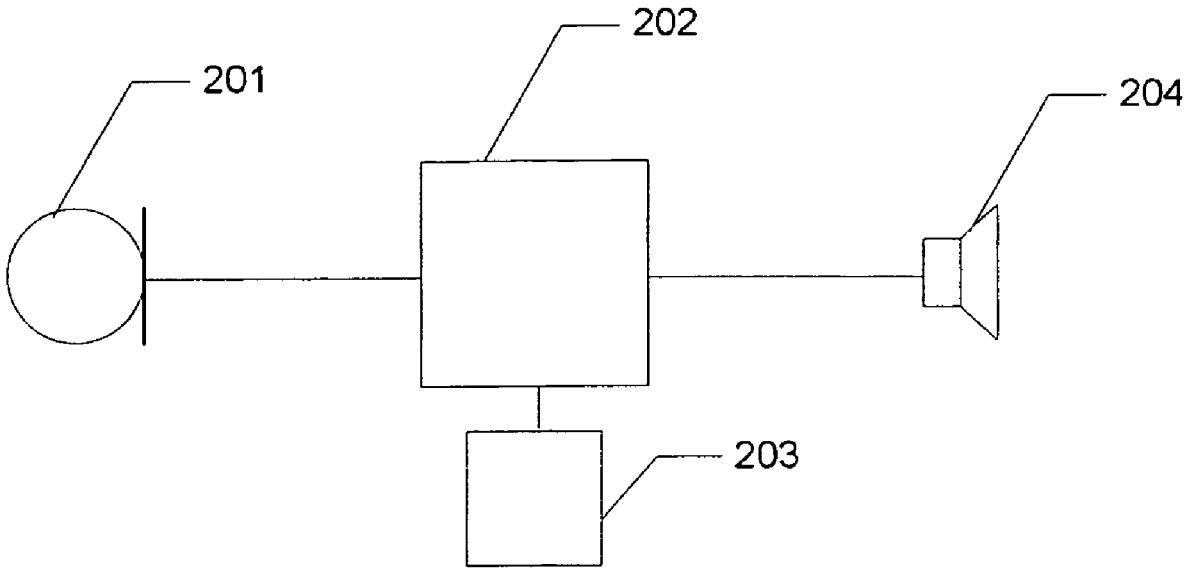
FIG. 2 shows a hearing aid adapted to be worn by a subject and configured to perform frequency transposition of received audio signals.

In FIG. 2, a hearing aid adapted to be worn by a subject and configured to perform frequency transposition of received audio signals is shown. The hearing aid comprises an input transducer 201, e.g. a microphone, processing means 202, storage means 203 and an output transducer 204, e.g. a loudspeaker. Audio signals are received by the input transducer 201, e.g. a microphone, converting a sound signal entering the ear from the surroundings of the subject to an electric sound signal. The electric sound signal is communicated to a processing unit 202, e.g. a suitably programmed general-purpose microprocessor, an ASIC, or any other suitable control circuitry, connected to storage means 203, e.g. a flash memory, an on-chip memory, or the like, where one or more subject-dependent configuration parameters indicative of the subject's ability to detect audio frequencies are stored. For example, the subject-dependent configuration parameter(s) may indicate a subject-dependent bandwidth of a transposed frequency region and a transition frequency between an unmodified baseband and a replaced frequency region. Alternatively or additionally, the subject-dependent configuration parameter(s) may be indicative of other forms of transformation as described herein. The subject-dependent configuration parameters may be determined by the methods described herein. Accordingly, the signal processing unit 202 is adapted to process the electric sound signal in accordance with a configured frequency transposition configured from the subject-dependent parameter.

From the processing unit 202 the processed/configured electric sound signal is communicated to an output transducer 204, e.g. a loudspeaker. The output transducer 204 converts the electric sound signal to a sound pressure signal, which is audible to the subject.

Even though FIG. 2 shows the processing means and the storage means as two separate units, it is to be understood that the processing means and the storage means may also be combined in one unit.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

It is noted that embodiments of the method described herein, and in particular the configuration of the frequency transposition described herein, may be implemented at least in part by means of hardware comprising several distinct elements, and/or by means of a data processing system or other processing means caused by the execution of computer program code means such as computer-executable instructions. In the device and system claims enumerating several means, several of these means can be embodied by one and the same item of hardware, e.g. a suitably programmed microprocessor or computer, and/or one or more communications interfaces as described herein. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A method of configuring a frequency transposition scheme for transposing a set of received frequencies of an audio signal received by a first and second hearing aid worn by a subject to a transposed set of frequencies, herein the method comprising:

determining at least one subject-dependent parameter indicative of the subject's ability to detect audio frequencies and at least one subject-dependent parameter indicative of the location in frequency of one or more spectral cues;

configuring a subject-dependent frequency transposition process based on the determined subject-dependent parameters, the subject-dependent frequency transposition being configured so as to improve the subject's spatial hearing capabilities;

synchronizing the frequency transposition across the two ears of the subject when the subject is wearing a hearing aid in both ears; and configuring the first and second hearing aid to perform the configured subject-dependent frequency transposition using the same determined subject-dependent parameters in each of the first and second hearing aid.

2. A method according to claim 1, wherein the frequency transposition is configured to downward-transpose at least one high-frequency region.

3. A method according to claim 1, wherein determining at least one of the subject-dependent parameters includes a geometric measurement of the physical dimensions of one or more anatomical features of at least one outer ear of the subject.

4. A method according to claim 1 wherein determining at least one of the subject-dependent parameters includes a geometric measurement of the physical dimensions of the subject's head.

5. A method according to claim 3, further comprising a comparison of the geometric measurement with predetermined physical models of the outer ear so as to determine at least one frequency region containing spectral cues which are to be transposed.

6. A method according to claim 3, wherein the geometric measurement is a measurement of at least one physical dimension of the outer ear itself, the concha cavity, the ear canal or any other anatomical feature of the outer ear.

7. A method according to claim 3, wherein at least one of the geometric measurements of a physical dimension is indicative of one or more of the following: the location in frequency of one or more predetermined spectral cues, the subject's head-related transfer function, the subject-dependent open-ear resonance, or a combination thereof.

8. A method according to claim 1, further comprising enhancement of individual spectral cues of the subject's head-related transfer function.

9. A method according to claim 1, wherein configuring a subject-dependent frequency transposition comprises determining a subject-dependent bandwidth of a transposed frequency region and a transition frequency between an unmodified baseband and a replaced frequency region.

10. A method according to claim 1, further comprising synchronizing dynamic range compression across the two ears of a subject when the subject is wearing a hearing aid in both ears.

11. A method according to claim 1, further comprising adjusting the frequency transposition according to a position of one or more microphones of the one or more hearing aids.

12. A method according to claim 1, further comprising determining a suitable frequency-dependent gain for audio signals processed through the hearing aid based on an estimate of the open-ear resonance.

13. A method according to claim 1, wherein performing the frequency transposition includes performing a Fast Fourier Transform.

14. A method according to claim 1, wherein performing the frequency transposition includes performing the frequency transposition by means of a filterbank.

15. A system for configuring a frequency transposition scheme for transposing a set of received frequencies of an audio signal received by a first and a second hearing aid worn by a subject to a transposed set of frequencies, the system comprising:

a receiver receiving at least one determined subject-dependent parameter indicative of the subject's ability to detect audio frequencies and at least one subject-dependent parameter indicative of the location in frequency of one or more spectral cues; and a processor configuring a subject-dependent frequency transposition process based on the determined subject-dependent parameters, the subject-dependent frequency transposition being configured so as to improve the subject's spatial hearing capabilities, wherein the processor further configures the first and second hearing aid to perform the configured subject-dependent frequency transposition using the same determined subject-dependent parameters in each of the first and the second hearing aid, and the processor synchronizes the frequency transposition across the two ears of the subject.

* * * * *